US009586120B1

(12) United States Patent
Sotelo

(10) Patent No.: US 9,586,120 B1
(45) Date of Patent: Mar. 7, 2017

(54) BOXING BUDDY SYSTEM

(71) Applicant: Ricardo Sotelo, Skokie, IL (US)

(72) Inventor: Ricardo Sotelo, Skokie, IL (US)

( * ) Notice: Subject to any disclaimer, the term of this patent is extended or adjusted under 35 U.S.C. 154(b) by 0 days.

(21) Appl. No.: 14/734,295

(22) Filed: Jun. 9, 2015

Related U.S. Application Data

(60) Provisional application No. 62/027,192, filed on Jul. 21, 2014.

(51) Int. Cl.
*A63B 69/32* (2006.01)
*A63B 24/00* (2006.01)
*A63B 69/20* (2006.01)

(52) U.S. Cl.
CPC ..... *A63B 69/32* (2013.01); *A63B 24/0087* (2013.01); *A63B 69/201* (2013.01)

(58) Field of Classification Search
CPC .... A63B 69/32; A63B 24/0087; A63B 69/201
See application file for complete search history.

(56) References Cited

U.S. PATENT DOCUMENTS 4,088,315 A * 5/1978 Schemmel ..... A63B 69/34 482/4
5,803,877 A 9/1998 Franey
7,857,729 B2 * 12/2010 Sullivan ..... A63B 69/004 482/1
7,909,749 B2 3/2011 Sheedy
8,337,366 B2 * 12/2012 Jones ..... A63B 69/004 482/8
8,602,949 B2 * 12/2013 Pelletter ..... A63B 69/004 434/247
2005/0266967 A1 * 12/2005 Considine ..... A63B 69/20 482/84
2005/0288159 A1 * 12/2005 Tackett ..... A63B 69/20 482/84
2006/0247106 A1 * 11/2006 Peavey ..... A63B 24/0003 482/83
2006/0252608 A1 * 11/2006 Kang ..... A63B 69/00 482/84
2007/0213182 A1 * 9/2007 Anderson ..... A63B 24/0003 482/83
2010/0130329 A1 * 5/2010 Sullivan ..... A63B 69/004 482/4
2010/0144414 A1 * 6/2010 Edis ..... A63B 24/0006 463/8
2011/0159939 A1 * 6/2011 Lin ..... A63B 69/004 463/8
2011/0172060 A1 * 7/2011 Morales ..... A63B 69/004 482/8
2011/0245045 A1 * 10/2011 Blaies ..... A63B 69/34 482/84
2011/0245046 A1 * 10/2011 Lan ..... A63B 69/32 482/84
2012/0053016 A1 3/2012 Williamson

* cited by examiner

*Primary Examiner* — Sundhara Ganesan

(57) ABSTRACT

An apparatus for a lifelike, automated, heavy punching bag that can parry punches using robotic arms able to rotate to right and left, and sense and record the weight and accuracy of punches delivered to it. The boxing buddy system may be used by aspiring boxers and other martial artists to deliver punches to various strategic points of their opponent's anatomy.

20 Claims, 6 Drawing Sheets

BOXING BUDDY SYSTEM

CROSS-REFERENCE TO RELATED APPLICATION

The present application is related to and claims priority from prior provisional application Ser. No. 62/027,192, filed Jul. 21, 2014 which application is incorporated herein by reference.

COPYRIGHT NOTICE

A portion of the disclosure of this patent document contains material which is subject to copyright protection. The copyright owner has no objection to the facsimile reproduction by anyone of the patent document or the patent disclosure, as it appears in the Patent and Trademark Office patent file or records, but otherwise reserves all copyright rights whatsoever. 37 CFR 1.71(d).

BACKGROUND OF THE INVENTION

The following includes information that may be useful in understanding the present invention(s). It is not an admission that any of the information provided herein is prior art, or material, to the presently described or claimed inventions, or that any publication or document that is specifically or implicitly referenced is prior art.

1. Field of the Invention

The present invention relates generally to the field of boxing training aids and more specifically relates to a boxing buddy system.

2. Description of the Related Art

Training devices are used by boxers and other practitioners of the various martial arts (MMA or mixed martial arts, kick-boxing, and so forth) where blows are delivered to an opponent by hand, fist, or feet. The training device frequently used is a heavy punching bag. Heavy bags may be suspended from above or free-standing with a weighted base; but either way, they present the training fighter not with an anatomically accurate "opponent" against whom to deliver blows, but only with a heavy cylinder. Considering this situation, it would be desirable to work out with a punching bag having characteristics of a real fighter including features to allow defensive actions. This would make a heavy-bag workout far more challenging, enjoyable, and effective in terms of developing accuracy in punches and kicks. A suitable solution is desirable.

Various attempts have been made to solve the above-mentioned problems such as those found in U.S. Pat. No. 7,909,749 to Richard Sheedy; U.S. Publication Number 2012/0053016 to Michael Williamson; and U.S. Pat. No. 5,803,877 to Thomas Franey. This art is representative of boxing training aids. None of the above inventions and patents, taken either singly or in combination, is seen to describe the invention as claimed.

Ideally, a boxing buddy system should provide a lifelike, automated, heavy punching bag that can parry punches with robotic arms, rotate to right and left, and sense and record the weight and accuracy of punches delivered to it for training aspiring boxers and other martial artists to deliver punches to various strategic points of their opponent's anatomy, while replicating the defensive moves of an actual human opponent; and, yet would operate reliably and be manufactured at a modest expense. Thus, a need exists for a reliable boxing buddy system to avoid the above-mentioned problems.

BRIEF SUMMARY OF THE INVENTION

In view of the foregoing disadvantages inherent in the known boxing training aids art, the present invention provides a novel boxing buddy system. The general purpose of the present invention, which will be described subsequently in greater detail is to provide a lifelike, automated, heavy punching bag.

A boxing buddy system is disclosed herein, in a preferred embodiment, comprising: a boxing-buddy-assembly having in structural arrangement a body, a body-mount, a plurality of cameras, a pair of gloves comprising a right-glove and a left-glove, and a mat.

The body, comprising a punching-bag, is able to be used for improving the boxing skills of a user. The punching-bag comprises an image of a professional boxer on a front-surface of the punching-bag; the image includes a face and a torso which serves as target-locations for the user. The face and the torso of the image each comprise a plurality of body-sensors strategically located to detect punches delivered from the user. The body further comprises a first-power-source, a punch-recorder-means, a punch-display, a robotic-right-arm and a robotic-left-arm.

Each of the robotic-right-arm and robotic-left-arm, comprising a shoulder-joint, an elbow-joint, and a wrist-joint, fixedly attached to an outer-surface of the punching-bag. Each of the robotic-right-arm and robotic-left-arm also comprise a motorized-motion-means able to manipulate the robotic-right-arm and the robotic-left-arm via the shoulder-joint, the elbow-joint and the wrist-joint. The robotic-right-arm and robotic-left-arm are able to be manipulated vertically and horizontally in relation to the punching-bag via the motorized-motion-means to simulate defensive motions common to boxing using flexing and moving of the shoulder-joint, the elbow-joint, and the wrist-joint of each of the robotic-right-arm and robotic-left-arm.

The punch-recorder-means comprises a micro-processor able to tally punches from the first-glove and second-glove, each comprising a boxing-glove, to the plurality of body-sensors. The micro-processor also transmits data to a punch-display, comprising a scorecard, located on the backside of the punching-bag. The user is also able to program information into the micro-processor including the length of time for the current training session. The session length information along with the tally of punches delivered by the user is displayed on the punch-display and the length of time and the tally of punches changes during the training session.

The first-power-source of the punching-bag comprises a first-battery-pack enclosed within a first-power-source-compartment of the punching-bag. The first-battery-pack provides power to the body-sensors located on the face and torso of the image, the micro-processor, the robotic-right-arm and the robotic-left-arm.

The body-mount comprises an attachment-means and a plurality of suspension-means. The punching-bag is suspended from a planer-surface, comprising a ceiling, via the body-mount which comprises a gimbaled, ball-bearing mechanism able to rotate 360 degrees on a horizontal plane such that the image faces the user as the user punches the punching-bag during the training session.

Each of the plurality of cameras, comprising exactly three cameras, are fixedly mounted to an outer-surface of the punching-bag. The cameras are fixedly attached to the punching-bag in a manner able to view and record actions of the user via the micro-processor. The plurality of cameras cover a range of 180 degrees to view the actions of the user from a left-side and a right-side of the punching-bag as the user moves around on the mat and delivers punches to the punching-bag. With data provided by the plurality of cameras, the micro-processor activates the robotic-right-arm and the robotic-left-arm to instantly assume defensive positions against the user.

The mat, preferably having an eight-foot square size, comprises a second-power-source and a plurality of mat-sensors. The mat-sensors are able to monitor the movement of the feet of the user during use of the boxing buddy system. The second-power-source comprises a second-battery-pack enclosed in a second-power-source-compartment of the mat. The second-battery-pack provides power to the mat-sensors that are strategically arranged on the top-surface of the mat.

The user wears the pair of boxing-gloves. The boxing-gloves and the mat are useful to the user when working with the boxing buddy system to improve boxing skills. Each of the pair of boxing-gloves comprise a plurality of glove-sensors able to record punches to the punching-bag such that the micro-processor is able to detect which of the right-glove and the left-glove delivered punches to the punching-bag.

The user is able set up the boxing buddy system by suspending the punching-bag from the planer-surface via the body-mount using the attachment-means, comprising a flattened metal sphere using attaching screws, and the plurality of suspension-means. The user then would place the mat in position for use, place the right-glove and the left-glove on hands, and use the boxing buddy system by punching the punching-bag with the right-glove and the left-glove.

While in use, the micro-processor activates the robotic-right-arm and the robotic-left-arm and via use of the plurality of body-sensors the micro-processor is able to monitor movement of the user via the plurality of cameras and movement of the user on the mat. The micro-processor is also able to rotate and position the punching-bag horizontally based on the position of the user on the mat and record punches from the user via the body-sensors and display a tally of punches on the punch-display.

The present invention holds significant improvements and serves as a boxing buddy system. For purposes of summarizing the invention, certain aspects, advantages, and novel features of the invention have been described herein. It is to be understood that not necessarily all such advantages may be achieved in accordance with any one particular embodiment of the invention. Thus, the invention may be embodied or carried out in a manner that achieves or optimizes one advantage or group of advantages as taught herein without necessarily achieving other advantages as may be taught or suggested herein. The features of the invention which are believed to be novel are particularly pointed out and distinctly claimed in the concluding portion of the specification. These and other features, aspects, and advantages of the present invention will become better understood with reference to the following drawings and detailed description.

BRIEF DESCRIPTION OF THE DRAWINGS

The figures which accompany the written portion of this specification illustrate embodiments and method(s) of use for the present invention, a boxing buddy system constructed and operative according to the teachings of the present invention.

The various embodiments of the present invention will hereinafter be described in conjunction with the appended drawings, wherein like designations denote like elements.

DETAILED DESCRIPTION

As discussed above, embodiments of the present invention relate to a boxing training aid and more particularly to a boxing buddy system as used to provide a lifelike training system for aspiring boxers.

Generally speaking, the boxing buddy system is a comprehensive solitary training system for aspiring boxers featuring a lifelike, automated, heavy punching bag that can parry punches with robotic arms, rotate to right and left, and sense and record the weight and accuracy of punches delivered to various strategic points of their opponent's anatomy, while replicating the defensive moves of an actual human opponent.

Figure 1:
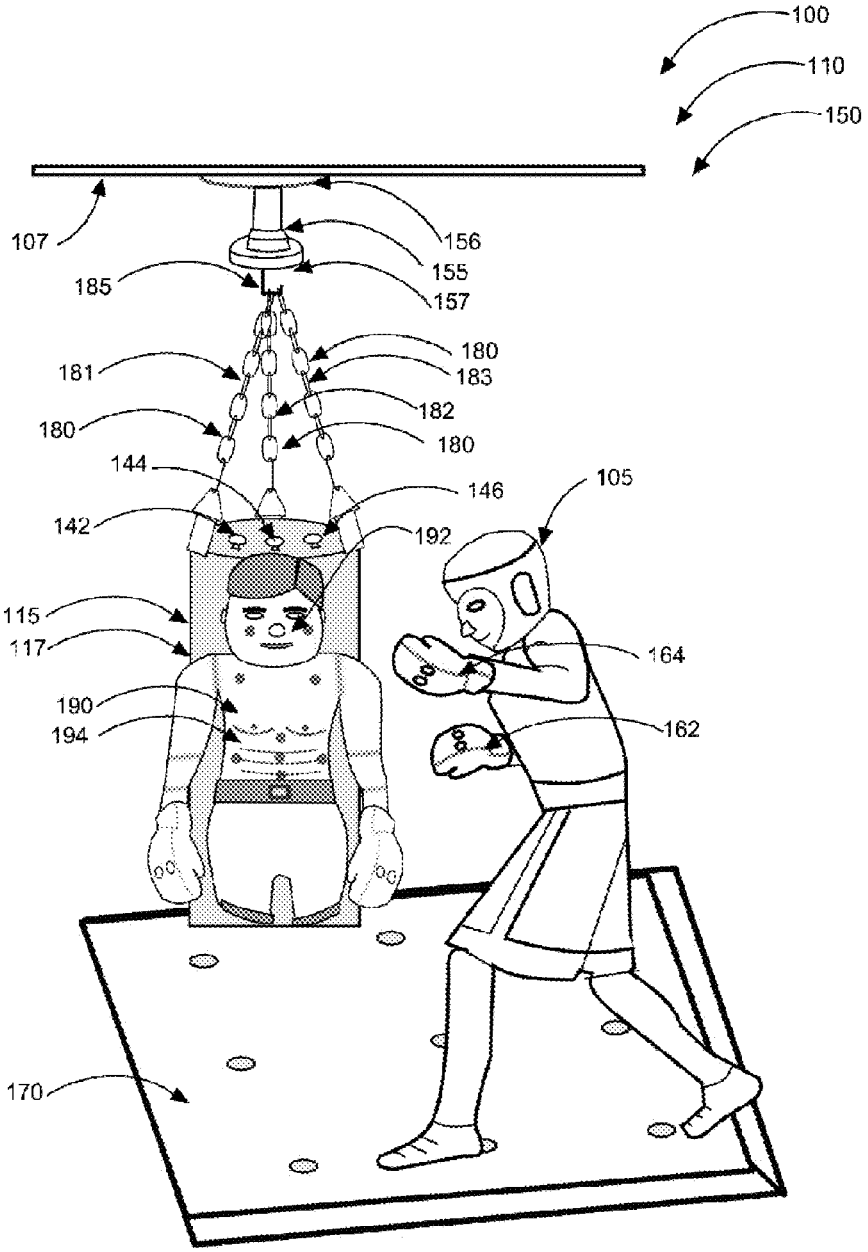
FIG. 1 shows a perspective view illustrating a boxing buddy system in an in use condition according to an embodiment of the present invention.

Referring to the drawings by numerals of reference there is shown in FIG. 1, a perspective view illustrating boxing buddy system 100 in an in use condition 150 according to an embodiment of the present invention.

Boxing buddy system 100 comprises: boxing-buddy-assembly 110 having in structural arrangement body 115, comprising punching-bag 117, body-mount 130, plurality of cameras 140, pair of gloves 160 comprising right-glove 162 and left-glove 162, and mat 170. Punching-bag 117 is a heavy-duty, realistic punching-bag 117 incorporating animatronic and electronic sensory technology to move, parry punches, and sense and record user's 105 punches.

User 105 is able set up boxing buddy system 100 by suspending punching-bag 117 from planer-surface 107 via body-mount 155 using attachment-means 156, comprising a flattened metal sphere using screws, and plurality of suspension-means 180, place mat 170 in position for use, place right-glove 162 and left-glove 164 on hands, and use boxing buddy system 100 by striking punching-bag 117 with right-glove 162 and left-glove 164.

While in use, punch-recorder-means 135, comprising micro-processor 128, activates robotic-right-arm 121 and robotic-left-arm 122 via use of plurality of body-sensors 130. Micro-processor 128 is able to monitor movement of user 105 via plurality of cameras 140 and movement of user 105 on mat 170. Micro-processor 128 is also able to rotate and position punching-bag 117 horizontally based on the position of user 105 on mat 170 and record punches from user 105 via body-sensors 130 and display a tally of punches on punch-display 132. Body-sensors 130 may comprise wired or wireless technology in communicating with micro-processor 128.

Figure 2:
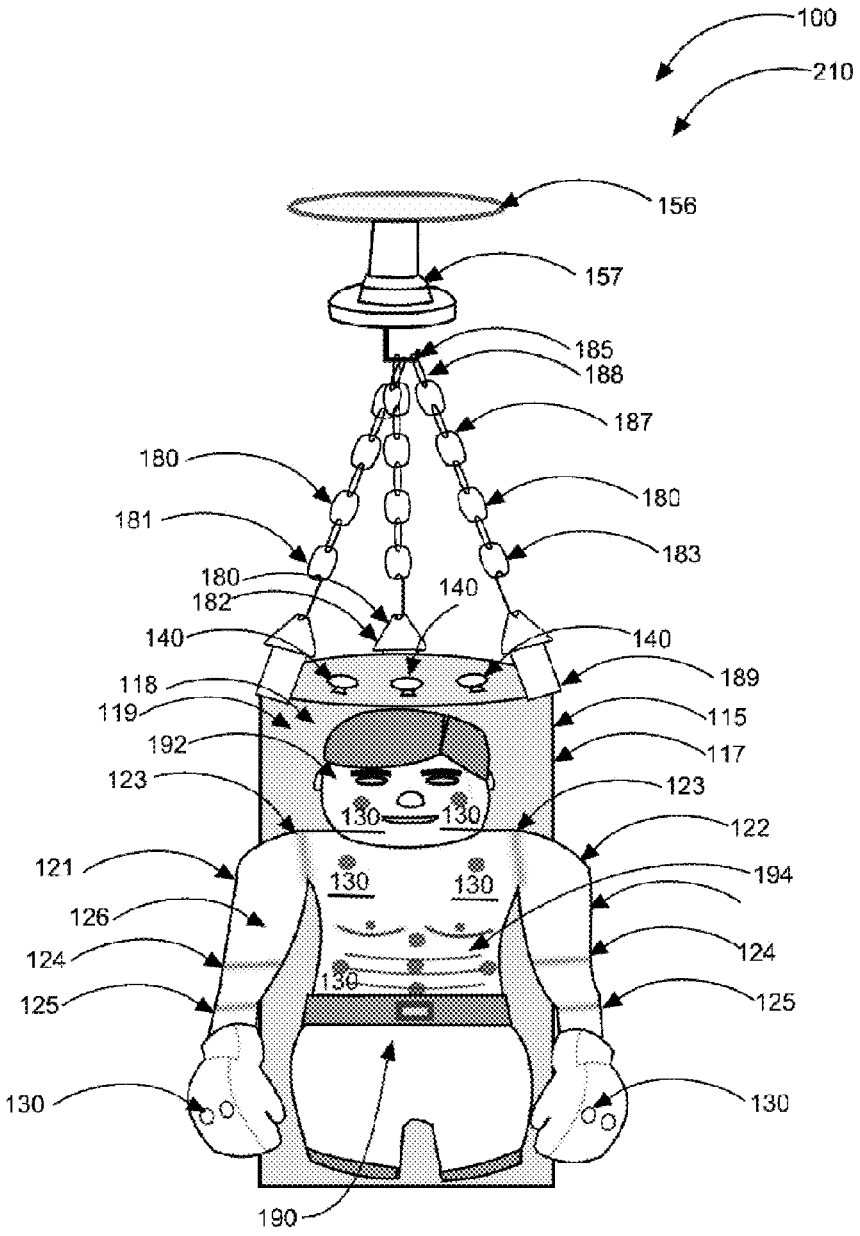
FIG. 2 is a perspective view illustrating a boxing buddy assembly according to an embodiment of the present invention of FIG. 1.

Referring now to FIG. 2, a perspective view illustrating boxing buddy system 100 according to an embodiment of the present invention of FIG. 1.

Body 115, comprising punching-bag 117, is able to be used for improving the boxing skills of user 105. Punching-bag 117 comprises image 190 of a professional boxer such as Manny Pacquiao on front-surface 119 of punching-bag 117. Image 190 includes face 192 and torso 194 which serves as target-locations for user 105. Face 192 and torso 194 of image 190 each comprise plurality of body-sensors 130 strategically located to detect punches delivered from user 105. In alternate embodiments, image 190 may be representative of any individual, whether a professional boxer or not. Body 115 further comprises first-power-source 134, punch-recorder-means 135, punch-display 132.

Each of robotic-right-arm 121 and robotic-left-arm 122, comprising shoulder-joint 123, elbow-joint 124, and wrist-joint 125, is fixedly attached to outer-surface 118 of punching-bag 117. Each of robotic-right-arm 121 and robotic-left-arm 122 also comprise motorized-motion-means 126 able to manipulate robotic-right-arm 121 and robotic-left-arm 122 via shoulder-joint 123, elbow-joint 124 and wrist-joint 125. Robotic-right-arm 121 and robotic-left-arm 122 are able to be manipulated vertically and horizontally in relation to punching-bag 117 via motorized-motion-means 126 to simulate defensive motions common to boxing using shoulder-joint 123, elbow-joint 124, and wrist-joint 125 of each of robotic-right-arm 121 and robotic-left-arm 122.

Body-mount 155 comprises attachment-means 156 and plurality of suspension-means 180 comprising first-suspension-means 181, second-suspension-means 182 and third-suspension-means 183. Punching-bag 117 is suspended from planer-surface 107, comprising a ceiling, via body-mount 155 which comprises hook 185 and gimbaled, ball-bearing mechanism 157 able to rotate 360 degrees on a horizontal plane such that image 190 of a professional boxer faces user 105 as user 105 punches punching-bag 117 during the training session. First-suspension-means 181, second-suspension-means 182 and third-suspension-means 183 are removably suspended from hook 185 of body-mount 155 via chain-link 187 having first-end 188 removably placed on hook 185 of body-mount 155. Second-end 189 of each of plurality of suspension-means 180 is fixedly attached to outer-surface 118 of punching-bag 117. In alternate embodiments, other suitable materials may be used for plurality of suspension-means 180.

Plurality of cameras 140, comprising first-camera 142, second-camera 144, and third-camera 146 are fixedly mounted to outer-surface 118 of punching-bag 117. Each of plurality of cameras 140 are fixedly attached to punching-bag 117 in a manner able to view actions of user 105 and record the actions of user 105 via micro-processor 128. Plurality of cameras 140 cover a range of 180 degrees to view the actions of user 105 from a left-side and a right-side of punching-bag 117 as user 105 moves around on mat 170 and delivers punches to punching-bag 117. With data provided by plurality of cameras 140, micro-processor 128 activates robotic-right-arm 121 and robotic-left-arm 122 to instantly assume defensive positions against user 105.

Figure 3:
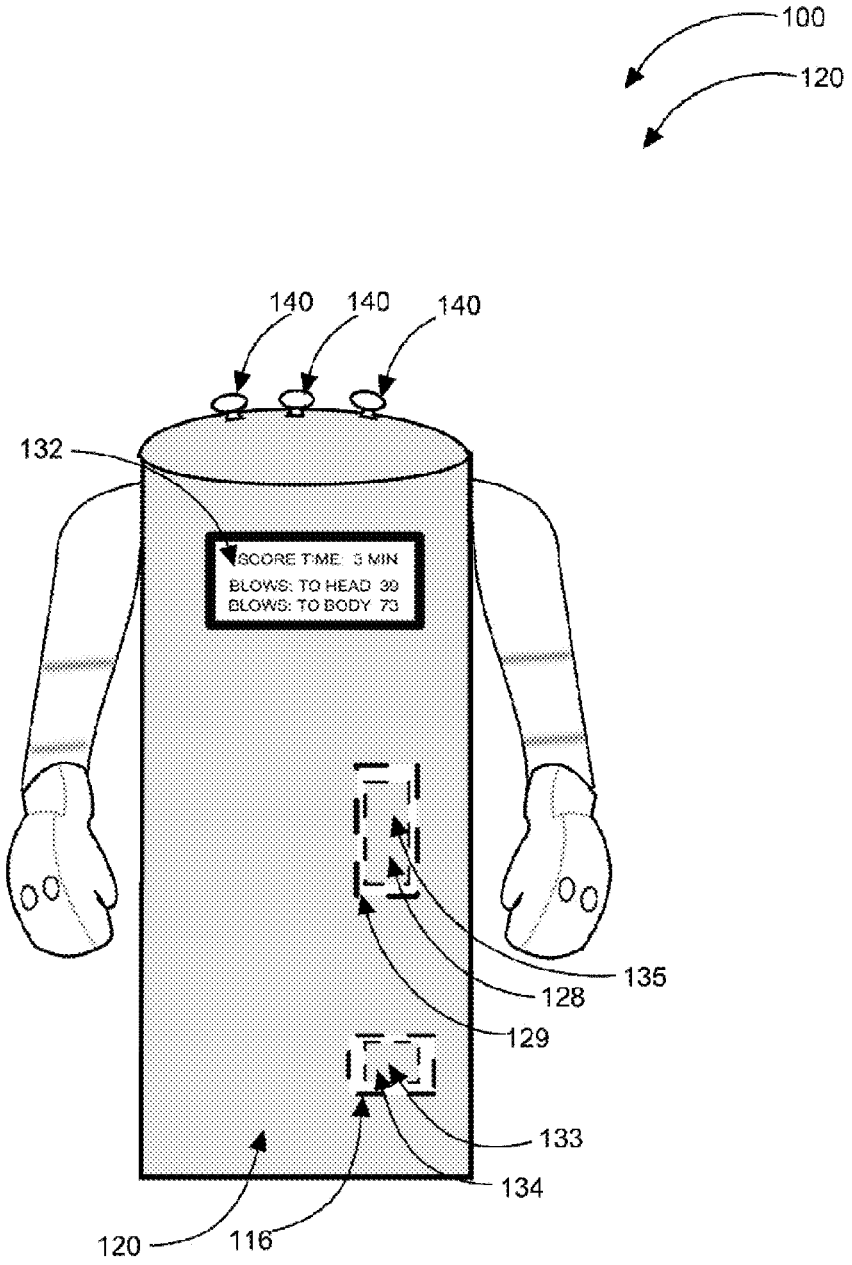
FIG. 3 is a perspective view illustrating components of the boxing buddy system according to an embodiment of the present invention of FIG. 1.

Referring now to FIG. 3, a perspective view illustrating boxing buddy system 100 according to an embodiment of the present invention of FIG. 1.

Punch-recorder-means 135 comprising micro-processor 128 located in micro-processor compartment 129 on backside 120 of punching-bag 117, is able to tally punches from first-glove 161 and second-glove 163, each comprising boxing-glove 166, to plurality of body-sensors 130. Micro-processor 128 also transmits data to punch-display 132, comprising a scorecard, located on backside 120 of punching-bag 117. User 105 is also able to program information into micro-processor 128 including the length of time for the current training session. The session length of time information along with the tally of punches delivered by user 105 are displayed on punch-display 132 and the length of time and the tally of punches changes during the training session as the training session progresses. Typically, the length of time programmed into micro-processor 128 may be a three minute round, a plurality of three minute rounds, or any length of time desired by user 105.

First-power-source 134 of punching-bag 117 comprises first-battery-pack 133 enclosed within first-power-source-compartment 116 of punching-bag 117. First-battery-pack 133 provides power to body-sensors 130 located on face 192 and torso 194 of image 190, micro-processor 128, robotic-right-arm 121 and robotic-left-arm 122. In alternate embodiments, first-power-source 134 may be AC power using a cord plugged into an AC connection on punching-bag 117 or any other source of power able to accomplish the purposes of buddy boxing system 100.

Figure 4A:
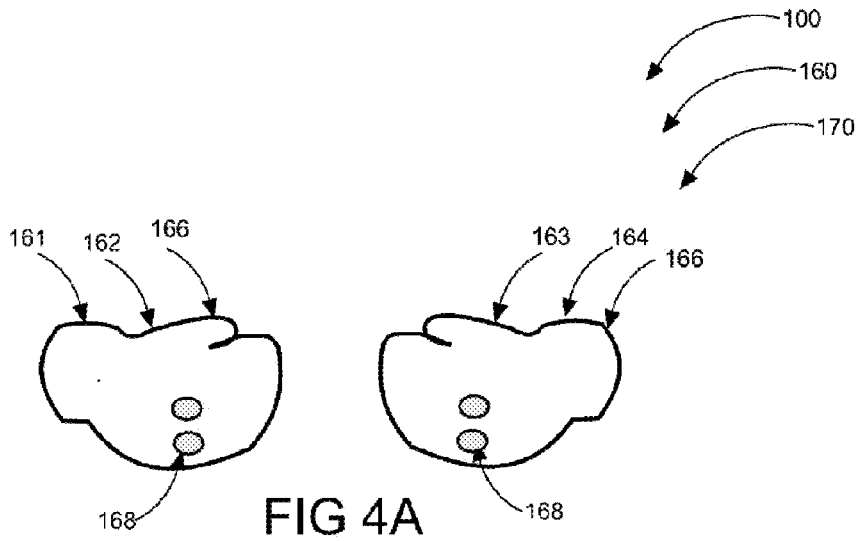
FIG. 4A is a perspective view illustrating gloves for use with the boxing buddy system according to an embodiment of the present invention of FIG. 1.

Referring now to FIG. 4A a perspective view illustrating boxing-gloves 160 for use with boxing buddy system 100 according to an embodiment of the present invention of FIG. 1.

User 105 wears pair of boxing-gloves 160 during the training session. Boxing-gloves 160 and mat 170 are useful to user 105 when working with boxing buddy system 100 to improve boxing skills. Each of pair of boxing-gloves 160 comprise a plurality of glove-sensors 168 able to record punches to punching-bag 117 such that micro-processor 128 is able to detect which of right-glove 162 and left-glove 164 delivered punches to punching-bag 117 during the training session.

Figure 4B:
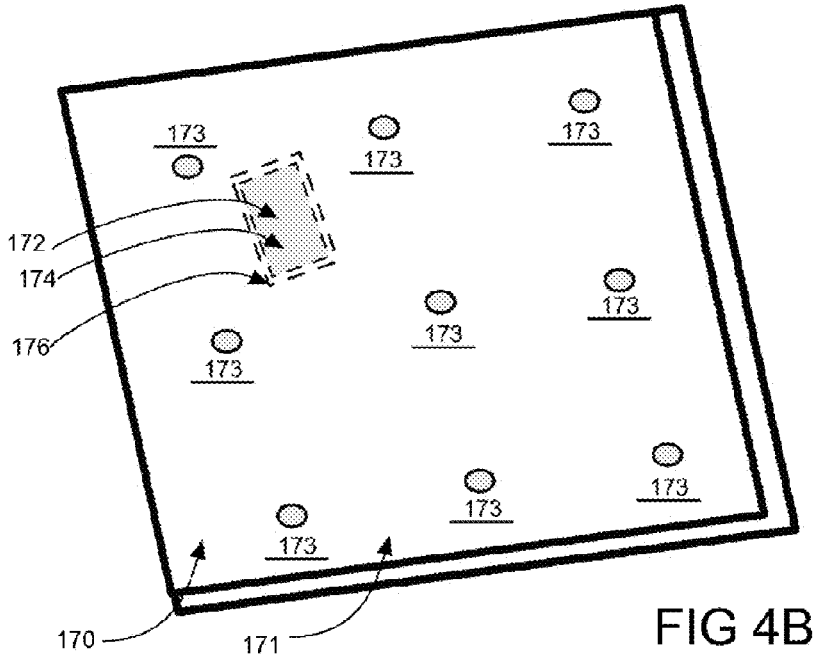
FIG. 4B is a perspective view illustrating an eight-foot padded square of the boxing buddy system according to an embodiment of the present invention of FIG. 1.

Referring now to FIG. 4B a perspective view illustrating an eight-foot padded square for use with boxing buddy system 100 according to an embodiment of the present invention of FIG. 1.

Mat 170, being an eight-foot padded square, comprises second-power-source 172 and plurality of mat-sensors 173. The size of mat 170 may be smaller or larger to accommodate a variety of desires of user 105. Mat-sensors 173 are strategically arranged on top-surface 171 of mat 170 and able to monitor the movement of the feet of user 105 to the left, the right as well as back and forth during use of boxing buddy system 100. Mat-sensors 173 may comprise wired or wireless technology able to communicate with micro-processor 128.

Second-power-source 172 comprises second-battery-pack 174 enclosed in second-power-source-compartment 176 of mat 170. Second-battery-pack 174 provides power to mat-sensors 173. In alternate embodiments, second-power-source 172 may be AC power using a cord plugged into an AC connection on punching-bag 117 or any other source of power able to accomplish the purposes of buddy boxing system 100.

Figure 5:
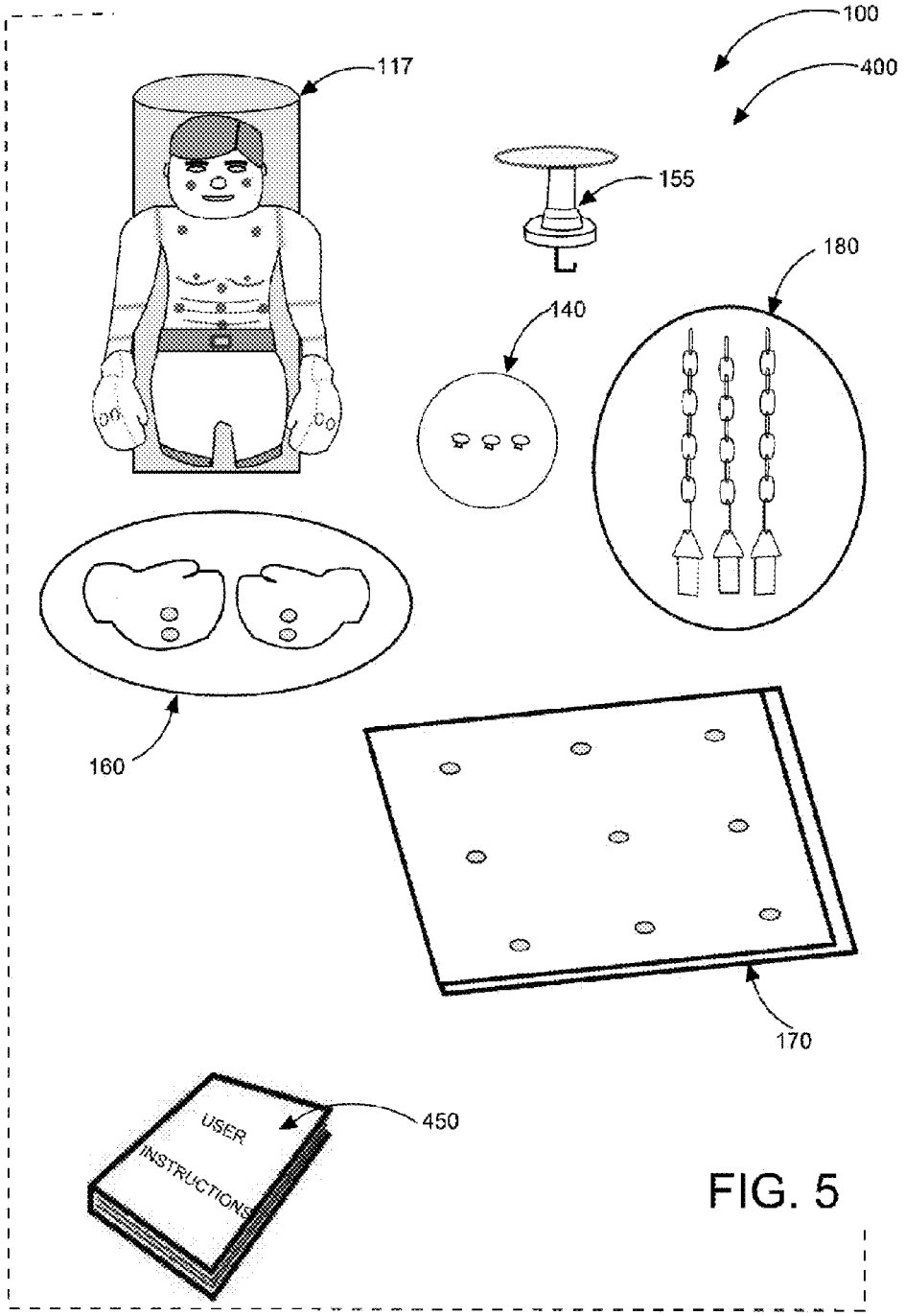
FIG. 5 showing a kit of the boxing buddy system according to an embodiment of the present invention of FIG. 1.

Referring now to FIG. 5, showing boxing buddy system 100; boxing buddy system 100 may be sold as kit 400 comprising the following parts: at least one punching-bag 117 including micro-processor 128 and first-battery-pack 133 at least one body-mount 155; at least one plurality of cameras 140 comprising first-camera 142, second-camera 144, and third-camera 146; at least one plurality of suspension-means 180 comprising first-suspension-means 181, second-suspension-means 182, and third-suspension-means 183; at least one pair of gloves 160 comprising first-glove 161 and second-glove 163; at least one mat 170 including second-battery-pack 174; and at least one set of user instructions 450. The kit has instructions such that functional relationships are detailed in relation to the structure of the invention (such that the invention can be used, maintained, or the like in a preferred manner). Boxing buddy system 100 may be manufactured and provided for sale in a wide variety of sizes and shapes for a wide assortment of applications. Upon reading this specification, it should be appreciated that, under appropriate circumstances, considering such issues as design preference, user preferences, marketing preferences, cost, structural requirements, available materials, technological advances, etc., other kit contents or arrangements such as, for example, including more or less components, customized parts, different powering combinations, parts may be sold separately, etc., may be sufficient.

Figure 6:
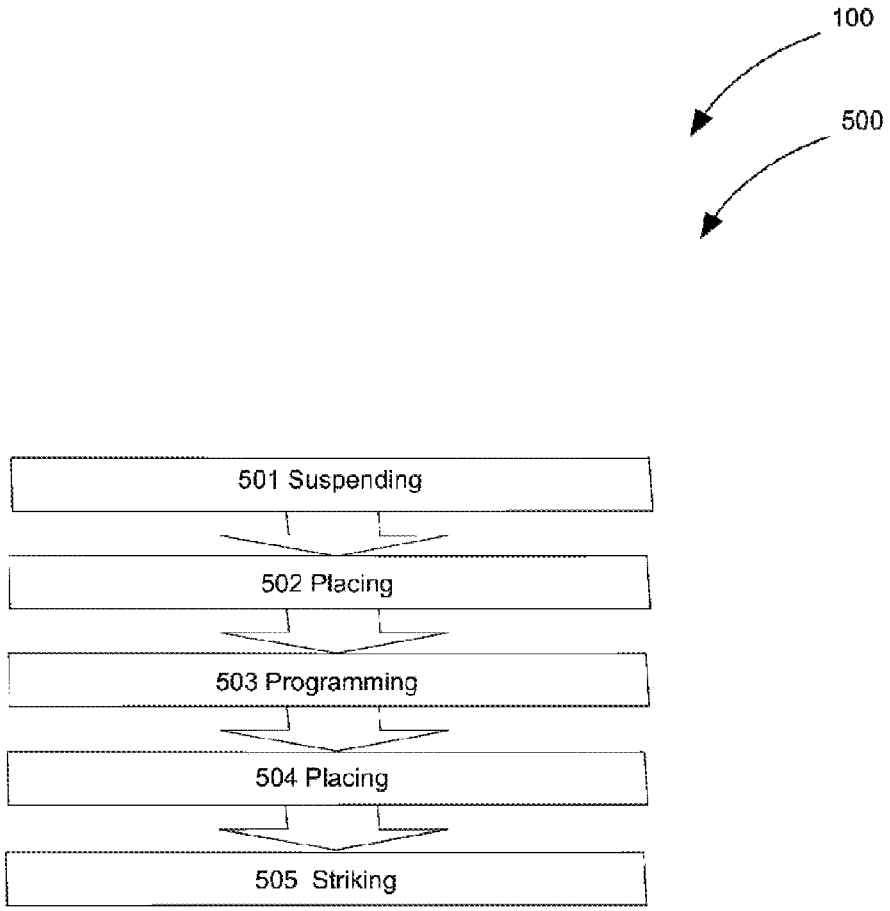
FIG. 6 is a flowchart illustrating a method of use for a boxing buddy system according to an embodiment of the present invention of FIGS. 1-5.

Referring now to FIG. 6, a flowchart illustrating a method of use 500 for boxing buddy system 100 according to an embodiment of the present invention of FIGS. 1-5.

A method of use 500 for boxing buddy system 100 may comprise the steps of: step one 501 suspending punching-bag 117 to planer-surface 107 via body-mount 155; step two 502 placing mat 170 in position for use; step three 503 programming micro-processor 128 for a training session; step four 504 placing right-glove 162 and left-glove 164 on hands; and step five 505 striking punching-bag 117 with right-glove 162 and left-glove 164.

It should be noted that step 505 may be repeated as often as desired to complete a training session. It should be noted that the steps described in the method of use can be carried out in many different orders according to user preference. The use of "step of" should not be interpreted as "step for", in the claims herein and is not intended to invoke the provisions of 35 U.S.C. §112, ¶6. Upon reading this specification, it should be appreciated that, under appropriate circumstances, considering such issues as design preference, user preferences, marketing preferences, cost, structural requirements, available materials, technological advances, etc., other methods of use arrangements such as, for example, different orders within above-mentioned list, elimination or addition of certain steps, including or excluding certain maintenance steps, etc., may be sufficient.

The embodiments of the invention described herein are exemplary and numerous modifications, variations and rearrangements can be readily envisioned to achieve substantially equivalent results, all of which are intended to be embraced within the spirit and scope of the invention. Further, the purpose of the foregoing abstract is to enable the U.S. Patent and Trademark Office and the public generally, and especially the scientist, engineers and practitioners in the art who are not familiar with patent or legal terms or phraseology, to determine quickly from a cursory inspection the nature and essence of the technical disclosure of the application.

What is claimed is:

1. A boxing buddy system comprising:

a boxing-buddy-assembly comprising;

a body;

a body-mount;

a plurality of cameras;

a pair of gloves comprising a right-glove and a left-glove; and a mat;

wherein said boxing buddy system comprises said boxing-buddy-assembly comprising in structural arrangement said body, said body-mount, said plurality of cameras, said pair of gloves comprising said right-glove and said left-glove, and said mat;

wherein said body comprises a first-power-source, a plurality of body-sensors, a punch-recorder-means, a punch-display, a robotic-right-arm and a robotic-left-arm;

wherein each of said robotic-right-arm and said robotic-left-arm are fixedly attached to an outer-surface of said body and comprise a shoulder-joint, an elbow-joint, and a wrist-joint;

wherein each of said robotic-right-arm and said robotic-left-arm comprise a motorized-animatronic-system able to manipulate said robotic-right-arm and said robotic-left-arm via said shoulder-joint, said elbow-joint and said elbow-joint;

wherein said body-mount comprises an attachment-means and a plurality of suspension-means;

wherein said body is suspended from a planer-surface via said body-mount;

wherein said plurality of cameras are fixedly mounted to said outer-surface of said body;

wherein said mat comprises a second-power-source and a plurality of mat-sensors able to monitor movement of feet of said user during use of said boxing buddy system;

wherein said pair of boxing-gloves and said boxing-mat are useful to said user when working with said boxing buddy system to improve boxing skills;

wherein said user is able to suspend said body to said planer-surface via said body-mount, place said mat in position for use, place said right-glove and said left-glove on hands of said user, and use said boxing buddy system by punching said body with said right-glove and said left-glove; and wherein while in use said plurality of body-sensors are able to monitor and record said punches from said user via said punch-recorder-means and display a tally of said punches on said punch-display.

2. The boxing buddy system of claim 1 wherein said body comprises a punching-bag able to be used for improving boxing skills of said user.

3. The boxing buddy system of claim 2 wherein said a punching-bag comprises an image of a boxer on a front-surface of said punching-bag having a face, and a torso.

4. The boxing buddy system of claim 3 wherein said face and said torso of said boxer each comprise a plurality of said body-sensors strategically located on said face and said torso, said body-sensors able to detect said punches delivered from said user.

5. The boxing buddy system of claim 1 wherein said robotic-right-arm and said robotic-left-arm are able to be manipulated vertically and horizontally in relation to said punching-bag via said motorized-animatronic-system to simulate defensive motions common to boxing.

6. The boxing buddy system of claim 5 wherein said robotic-right-arm and said robotic-left-arm are able to be manipulated vertically and horizontally in relation to said punching-bag via said shoulder-joint, said elbow-joint, and said wrist-joint.

7. The boxing buddy system of claim 1 wherein said punch-recorder-means comprises a micro-processor able to tally said punches from said first-glove comprising a boxing-glove and said second-glove comprising said boxing glove to each of said body-sensors and provide a visual display to said user via said punch-display, comprising a scorecard, located on a backside of said punching-bag.

8. The boxing buddy system of claim 1 wherein said first-power-source of said punching-bag comprises a first-battery-pack enclosed within a first-power-source-compartment of said punching-bag.

9. The boxing buddy system of claim 8 wherein said first-battery-pack provides power to said body-sensors, said micro-processor, said robotic-right-arm and said robotic-left-arm.

10. The boxing buddy system of claim 1 wherein said plurality of cameras comprise exactly three said cameras fixedly attached to a top-side of said punching-bag in a manner able to view actions of said user.

11. The boxing buddy system of claim 10 wherein said plurality of cameras cover a range of 180 degrees to view said actions of said user from a left-side and a right-side of said punching-bag as said user moves on said mat and delivers said punches to said punching-bag.

12. The boxing buddy system of claim 11 wherein said plurality of cameras, in conjunction with said micro-processor, activates said robotic-right-arm and said robotic-left-arm.

13. The boxing buddy system of claim 1 wherein each of said pair of boxing-gloves comprise a plurality of glove-sensors, said glove-sensors able to record punches to said punching-bag such that said micro-processor is able to detect which of said right-glove and said left-glove delivered said punches to said punching-bag.

14. The boxing buddy system of claim 1 wherein said second-power-source comprises a second-battery-pack enclosed in a second-power-source-compartment of said mat.

15. The boxing buddy system of claim 14 wherein said second-battery-pack provides power to said plurality of mat-sensors.

16. The boxing buddy system of claim 1 wherein said body-mount is able to rotate 360 degrees on a horizontal place to face said user.

17. The boxing buddy system of claim 16 wherein said body-mount comprises a gimbaled, ball-bearing mechanism able to rotate 360 degrees on a horizontal plane such that said image of said boxer faces said user.

18. The boxing buddy system of claim 1 wherein said user is able to program said micro-processor to indicate a time-length of a training-session, said time-length being displayed on said punch-display.

19. A boxing buddy system comprising:

a boxing-buddy-assembly comprising;

a body;

a body-mount;

a plurality of cameras;

a pair of gloves comprising a right-glove and a left-glove; and a mat;

wherein said boxing buddy system comprises said boxing-buddy-assembly comprising in structural arrangement said body, said body-mount, said plurality of cameras, said pair of gloves comprising said right-glove and said left-glove, and said mat;

wherein said body comprises a punching-bag able to be used for improving boxing skills of said user;

wherein said a punching-bag comprises an image of a boxer on a front-surface of said punching-bag having a face, and a torso;

wherein said face and said torso of said boxer each comprise a plurality of said body-sensors strategically located on said face and said torso, said body-sensors able to detect said punches delivered from said user;

wherein said body comprises a first-power-source, a plurality of body-sensors, a punch-recorder-means, a punch-display, a robotic-right-arm and a robotic-left-arm;

wherein each of said robotic-right-arm and said robotic-left-arm are fixedly attached to an outer-surface of said body and comprise a shoulder-joint, an elbow-joint, and a wrist-joint;

wherein each of said robotic-right-arm and said robotic-left-arm comprise a motorized-animatronic-system able to manipulate said robotic-right-arm and said robotic-left-arm via said shoulder-joint, said elbow-joint and said elbow-joint;

wherein said robotic-right-arm and said robotic-left-arm are able to be manipulated vertically and horizontally in relation to said punching-bag via said motorized-animatronic-system to simulate defensive motions common to boxing;

wherein said robotic-right-arm and said robotic-left-arm are able to be manipulated vertically and horizontally in relation to said punching-bag via said shoulder-joint, said elbow-joint, and said wrist-joint;

wherein said punch-recorder-means comprises a micro-processor able to tally said punches from said first-glove comprising a boxing-glove and said second-glove comprising said boxing glove to each of said body-sensors and provide a visual display to said user via said punch-display, comprising a scorecard, located on a backside of said punching-bag;

wherein said user is able to program said micro-processor to indicate a time-length of a training-session, said time-length being displayed on said punch-display;

wherein said first-power-source of said punching-bag comprises a first-battery-pack enclosed within a first-power-source-compartment of said punching-bag;

wherein said first-battery-pack provides power to said body-sensors, said micro-processor, said robotic-right-arm and said robotic-left-arm;

wherein said body-mount comprises an attachment-means and a plurality of suspension-means;

wherein said plurality of cameras are fixedly mounted to said outer-surface of said body wherein said plurality of cameras comprise exactly three said cameras fixedly attached to a top-side of said punching-bag in a manner able to view actions of said user;

wherein said plurality of cameras cover a range of 180 degrees to view said actions of said user from a left-side and a right-side of said punching-bag as said user moves on said mat and delivers said punches to said punching-bag;

wherein said plurality of cameras, in conjunction with said micro-processor, activates said robotic-right-arm and said robotic-left-arm;

wherein said body is suspended from a planer-surface via said body-mount;

wherein said body-mount comprises a gimbaled, ball-bearing mechanism able to rotate 360 degrees on a horizontal plane such that said image of said boxer faces said user;

wherein said body-mount is able to rotate 360 degrees on a horizontal place to face said user;

wherein said mat comprises a second-power-source and a plurality of mat-sensors able to monitor movement of feet of said user during use of said boxing buddy system;

wherein said second-power-source comprises a second-battery-pack enclosed in a second-power-source-compartment of said mat;

wherein said pair of boxing-gloves and said boxing-mat are useful to said user when working with said boxing buddy system to improve boxing skills;

wherein said second-battery-pack provides power to said plurality of mat-sensors;

wherein each of said pair of boxing-gloves comprise a plurality of glove-sensors, said glove-sensors able to record punches to said punching-bag such that said micro-processor is able to detect which of said right-glove and said left-glove delivered said punches to said punching-bag;

wherein said user is able to suspend said body to said planer-surface via said body-mount, place said mat in position for use, place said right-glove and said left-glove on hands of said user, and use said boxing buddy system by punching said body with said right-glove and said left-glove; and wherein while in use said plurality of body-sensors are able to monitor and record said punches from said user via said punch-recorder-means and display a tally of said punches on said punch-display.

20. The boxing buddy system of claim 19 comprising a kit including: at least one said punching-bag including said micro-processor and said first-battery-pack, at least one said body-mount, at least one said plurality of cameras comprising said first-camera, said second-camera, and said third-camera, at least one said plurality of suspension-means comprising said first-suspension-means, said second-suspension-means, and said third-suspension-means, at least one said pair of gloves comprising said first-glove and second-glove, at least one said mat including said second-battery-pack, and at least one set of user instructions.

* * * * *